US010794623B1

(12) United States Patent
Zhang et al.

(10) Patent No.: US 10,794,623 B1
(45) Date of Patent: Oct. 6, 2020

(54) HEATING CONTROL METHOD, DEVICE AND ICE MAKER

(71) Applicants: HEFEI MIDEA REFRIGERATOR CO., LTD., Hefei (CN); HEFEI HUALING CO., LTD., Hefei (CN); MIDEA GROUP CO., LTD., Foshan (CN)

(72) Inventors: Jingyu Zhang, Hefei (CN); Yu Li, Hefei (CN); Deming Wei, Hefei (CN)

( * ) Notice: Subject to any disclaimer, the term of this patent is extended or adjusted under 35 U.S.C. 154(b) by 0 days.

(21) Appl. No.: 16/706,839

(22) Filed: Dec. 9, 2019

Related U.S. Application Data

(63) Continuation of application No. PCT/CN2019/090515, filed on Jun. 10, 2019.

(30) Foreign Application Priority Data

May 31, 2019 (CN) ..... 2019 1 0470216

(51) Int. Cl.

| | |
|---|---|
| ***F25C 5/08*** | (2006.01) |
| *F25C 1/25* | (2018.01) |
| *B67D 3/00* | (2006.01) |
| *B67D 1/08* | (2006.01) |

(52) U.S. Cl.
CPC ..... *F25C 5/08* (2013.01); *B67D 1/0895* (2013.01); *B67D 3/0022* (2013.01); *F25C 1/25* (2018.01); *F25C 2500/08* (2013.01); *F25C 2600/02* (2013.01); *F25C 2600/04* (2013.01); *F25C 2700/14* (2013.01)

(58) Field of Classification Search
CPC ..... F25C 2400/14; F25C 1/04; F25C 1/25; F25C 1/08; F25C 2400/10; F25C 2400/02; F25C 5/08; F25C 2600/02; F25C 2700/14; F25C 2500/08; F25C 2600/04; F25D 2323/122; B67D 1/0895; B67D 3/0022
See application file for complete search history.

(56) References Cited

U.S. PATENT DOCUMENTS 4,142,377 A * 3/1979 Fogt ..... F25C 1/04 62/135
2018/0266745 A1* 9/2018 Bertolini ..... F25D 21/14

FOREIGN PATENT DOCUMENTS

DE 102012202790 A1 * 8/2013 ..... F25D 21/02
JP 2008020158 A * 1/2008

* cited by examiner

*Primary Examiner* — Frantz F Jules
*Assistant Examiner* — Lionel Nouketcha
(74) *Attorney, Agent, or Firm* — Kilpatrick Townsend & Stockton, LLP

(57) ABSTRACT

The embodiments of the present disclosure provide a heating control method, a heating control device, and an ice maker. The heating control method comprises: determining that the ice maker is in an ice-making operation state; acquiring a first heating strategy of a target part of the ice maker according to a preset first heating strategy acquisition rule, based on ambient parameter information of an ambient in which the target part of the ice maker is located; and heating the target part based on the first heating strategy. Through the embodiments of the present disclosure, the problem that the deicing heating control technology of the ice maker in the prior art has high energy consumption is solved, and the beneficial effect of precise and low-energy deicing heating control on the ice-prone parts of the ice maker is achieved.

15 Claims, 5 Drawing Sheets

HEATING CONTROL METHOD, DEVICE AND ICE MAKER

CROSS-REFERENCE TO RELATED APPLICATION

The present application is a continuation of International Application No. PCT/CN2019/090515, filed on Jun. 10, 2019, which claims priority to Chinese patent application No. 201910470216.7 filed on May 31, 2019, entitled "HEATING CONTROL METHOD, DEVICE AND ICE MAKER", which is incorporated herein by reference in its entirety.

FILED

The present application relates to the field of electrical intelligent control technologies, and in particular, to a heating control method, a heating control device and an ice maker.

BACKGROUND

An ice maker is a kind of ice-making mechanical equipment to produce ice by cooling water using a refrigerating agent of an ice making system through an evaporator, and the ice is manufactured by adopting the ice making system, using water as carrier through a certain apparatus in the energized state. Depending on difference of the principle and the production method of the evaporator, shapes of the generated ice cubes are also different; generally, the ice maker is divided into particle ice maker, flake ice maker, plate ice maker, tube ice maker, shell ice maker, etc. in the shapes of ice cubes.

After the end of one ice making operation, the water remaining in the inlet pipe, the ice outlet or the dispenser of the ice maker is easily condensed into ice due to the cold temperature or low room temperature after the ice making operation is finished. Therefore, the normal ice making of the ice maker will be affected when it starts the next ice making operation. In the prior art, as long as the ice maker is in an power-on state, the corresponding heaters at the inlet water pipe, the ice outlet or the dispenser are always in the heating state, or the heating operation is performed according to the on-off-ratio at fixed time to prevent the water remaining in the inlet pipe, the ice outlet or the dispenser of the ice maker being condensed into ice, which in turn affects the normal ice making of the ice maker.

Therefore, the deicing heating control technology of the ice maker in the prior art has a problem of high energy consumption.

SUMMARY

The embodiments of the present disclosure provide a heating control method, a heating control device, and an ice maker for solving the problem of high energy consumption in the deicing heating control technology of the ice maker in the prior art.

According to a first aspect of the embodiments of the present disclosure, a heating control method is provided comprising:

determining that the ice maker is in an ice-making operation state;

acquiring a first heating strategy of a target part of the ice maker according to a preset first heating strategy acquisition rule, based on ambient parameter information of an ambient in which the target part of the ice maker is located; and heating the target part based on the first heating strategy.

According to a second aspect of the embodiment of the present disclosure, a heating control device is provided comprising a control module and heaters, the heaters are arranged corresponding to a target part of the ice maker:

The control module is configured to determine that the ice maker is in an ice-making operation state; acquire a first heating strategy of a target part of the ice maker according to a preset first heating strategy acquisition rule, based on ambient parameter information of an ambient in which the target part of the ice maker is located; and control heaters to heat the target part based on the first heating strategy.

According to a third aspect of the embodiments of the present disclosure, an ice maker is provided, comprising the control device according to any one of the embodiments described above.

According to a fourth aspect of embodiments of the present disclosure, an electronic apparatus is provided comprising a memory, a processor, and computer programs stored on the memory and executable on the processor, the processor implements steps of the heating control method according to any one of the embodiments described above when executing the computer programs.

According to a fifth aspect of embodiments of the present disclosure, a non-transitory computer readable storage medium is provided, the non-transitory computer readable storage medium stores computer instructions that cause the computer to perform the heating control method according to any one of the embodiments described above.

The embodiments of the present disclosure provide a heating control method, a heating control device, and an ice maker. The heating control method comprises: determining that the ice maker is in an ice-making operation state; acquiring a first heating strategy of a target part of the ice maker according to a preset first heating strategy acquisition rule, based on ambient parameter information of an ambient in which the target part of the ice maker is located; and heating the target part based on the first heating strategy. Through the embodiments of the present disclosure, the problem that the deicing heating control technology of the ice maker in the prior art has high energy consumption is solved, and the beneficial effect of precise and low-energy deicing heating control of the ice-prone parts of the ice maker is achieved.

BRIEF DESCRIPTION OF THE DRAWINGS

In order to more clearly illustrate the technical solutions disclosed in the embodiments of the present disclosure or the prior art, the drawings used in the descriptions of the embodiments or the prior art will be briefly introduced below. Obviously, the drawings in the following description are only certain embodiments of the present disclosure, and other drawings can be obtained according to these drawings without any creative work for those skilled in the art.

DETAILED DESCRIPTION

In order to make the object, technical solutions and advantages of the embodiments of the present disclosure more clear, the technical solutions in the embodiments of the present disclosure are clearly and completely described in the following with reference to the accompanying drawings in the embodiments of the present disclosure. Obviously, the described embodiments are a part of the embodiments of the present disclosure, and not all of the embodiments. All other embodiments obtained by a person of ordinary skill in the art based on the embodiments of the present disclosure without any creative work belong to the scope of the present disclosure.

Figure 1:
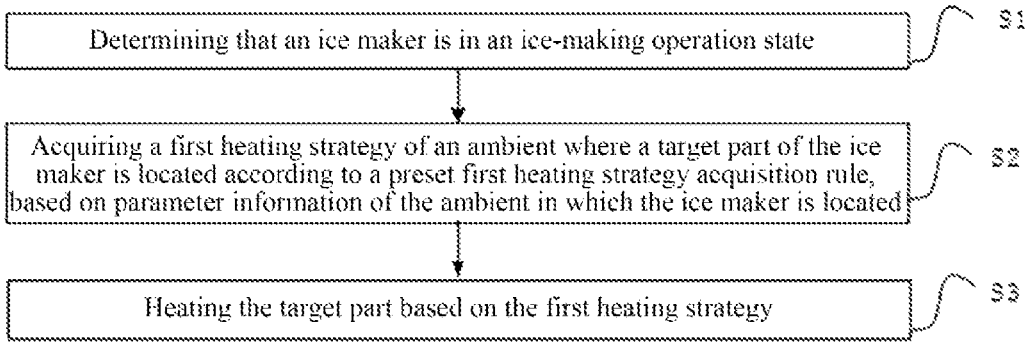
FIG. 1 is a schematic overall flow chart of a heating control method according to an embodiment of the present disclosure.

In FIG. 1, a schematic overall flow chart of a heating control method according to an embodiment of the present disclosure is shown comprising:

S1, determining that an ice maker is in an ice-making operation state;

S2, acquiring a first heating strategy of a target part of the ice maker according to a preset first heating strategy acquisition rule, based on ambient parameter information of an ambient in which the target part of the ice maker is located; and

S3, heating the target part based on the first heating strategy.

It should be noted that, in order to save energy consumption, in the embodiments of the present disclosure, unlike the deicing heating control technology of the ice maker in the prior art, when the ice maker is in an power-on state, the heaters at the ice-prone parts of the ice maker are not always in the heating state, and the heating operation is not performed according to the on-off-ratio at fixed time. Generally speaking, the ice maker will cause the ice-prone target part to become clogged in the following two cases, and the water cannot enter the ice maker, which affects the ice maker for normal ice making. One case is that water in the ice-prone target part of the ice maker is frozen due to the influence of the cold temperature after the end of the last or last few ice-making operation states; and the other case is that water in the ice-prone target part of the ice maker is frozen due to too low external room temperature. Usually, the ice maker does not enter the ice-making operation state at the first time after being turned on, and it will cause the loss of electric energy if the ice-prone target part of the ice maker is deiced immediately by being heated after the ice maker is turned on. At the same time, water in the ice-prone target part of the ice maker is possible to be frozen again before the ice maker becomes the ice-making operation state next time, which further aggravates the loss of electric energy. In an embodiment of the present disclosure, the ice-prone target part of the ice maker is a water inlet pipe of the ice maker, an ice outlet of the ice maker or a dispenser of the ice maker.

Therefore, further, according to the embodiment of the present disclosure, the target part of the ice maker is not heated at the first time after the ice maker is turned on, but the ice maker is firstly determined to be in the ice-making operation state while ambient parameter information of an ambient in which the target part of the ice maker is located is acquired. The ice maker can be determined to be in the ice-making operation state through at least the following two ways: the compressor of the ice maker is determined to be operating, or the ice maker is determined to be performing the ice-making process through the control chip of the ice maker. Taking into account the influence of the ambient of different temperatures or different humidity on the deicing heating speed of the ice-prone target part of the ice maker, for example, the deicing heating speed of the ice-prone target part of the ice maker at a low ambient temperature is slower compared to that at a high ambient temperature; and the deicing heating speed of the ice-prone target part of the ice maker at a high ambient humidity is slower compared to that at a low ambient humidity. Therefore, according to an embodiment of the present disclosure, the first heating strategy of a target part of the ice maker is acquired according to a preset first heating strategy acquisition rule, based on acquired ambient parameter information of the ice maker. In an embodiment of the present disclosure, the first heating strategy acquisition rule is any one of: acquiring a deicing heating control strategy having the time on-off ratio of the corresponding heaters, corresponding to the ambient parameter information of different numerical intervals; or acquiring a deicing heating control strategy having the corresponding heating power, corresponding to the ambient parameter information of different numerical intervals; or acquiring a deicing heating control strategy having the corresponding heating duration, corresponding to the ambient parameter information of different numerical intervals.

It is determined that whether the ice maker is in an ice-making operation state, the ambient temperature and the humidity are distinguished when the ice maker is in the ice-making operation state, and the heater at the target part is controlled to be operated according to different on-off ratios or heating powers or heating durations. When the ambient temperature is >T1 and the ambient humidity is >H1, the heater at the target part is controlled to de-ice and heat the target part with an on-off ratio or a heating power or a heating duration B1; when T1≥the ambient temperature >T2, and H1≥the ambient humidity >H2, the heater at the target part is controlled to de-ice and heat the target part with an on-off ratio or a heating power or a heating duration B2; when T2 the ambient temperature>T3, and H2≥the ambient humidity>H3, the heater at the target part is controlled to de-ice and heat the target part with an on-off ratio or a heating power or a heating duration B3. When the strategy is the on-off ratio, the value is 1:2, the heater is controlled to be turned on for 1 unit of time, and to be tuned off for 2 units of time. When the strategy is heating power and the value thereof is 1.5 KW/h, the heater is controlled to be operated at 1.5 KW/h. When the strategy is the heating duration and the value thereof is 30 minutes, the heater is controlled to be operated for 30 minutes at a standard power. Based on the first heating strategy, the heaters are controlled to heat the target part of the ice maker. In an embodiment of the present disclosure, the heaters are any kind of device of the prior art that heats the target part of the ice maker, and the heaters for the target part of the ice maker in the prior art are usually heating resistor wires or infrared heaters, etc. In an embodiment of the present disclosure, which first heating strategy corresponding to the different ambient parameter information among the first heating policy acquisition rules is preset, and pre-calculated or pre-measured according to the structure and size of the target part of the ice maker and the heating power of the heaters; the first heating strategy is needed to ensure that after the target part of the ice maker is heated, no ice is present in the target part of the ice maker or even if ice is present, the ice maker can normally operate. In an embodiment of the present disclosure, the ambient parameter information includes one or more of the temperature and humidity. This embodiment is not specifically limited.

In the embodiments of the present disclosure, a heating control method is provided comprising: determining that the ice maker is in an ice-making operation state; acquiring a first heating strategy of a target part of the ice maker according to a preset first heating strategy acquisition rule, based on ambient parameter information of an ambient in which the target part of the ice maker is located; and heating the target part based on the first heating strategy. Therefore, the problem that the deicing heating control technology of the ice maker in the prior art has high energy consumption is solved, and the beneficial effect of precise and low-energy deicing heating control of the ice-prone parts of the ice maker is achieved.

Based on the specific embodiments of the present disclosure above, a heating control method is provided further comprising:

S1', determining that an ice maker is in a non-ice-making operation state;

S2', acquiring a second heating strategy of a target part of the ice maker according to a preset second heating strategy acquisition rule, based on ambient parameter information of an ambient in which the target part of the ice maker is located; and S3', heating the target part based on the second heating strategy.

It should be noted that, similar to the previous embodiment, in the embodiment of the present disclosure, the target part of the ice maker is not heated at the first time after the ice maker is turned on, but the ice maker is firstly determined to be in the non-ice-making operation state while ambient parameter information of an ambient in which the target part of the ice maker is located is acquired. The ice maker can be determined to be in the non-ice-making operation state through at least the following two ways: the compressor of the ice maker is determined to not operate, or the ice maker is determined to not perform the ice-making process through the control chip of the ice maker. It is also taken into account that the ambient of different temperatures or different humidity will affect the deicing heating speed of the ice-prone target part of the ice maker. Therefore, according to an embodiment of the present disclosure, the second heating strategy of a target part of the ice maker is acquired according to a preset second heating strategy acquisition rule, based on acquired ambient parameter information of the ice maker. With respect to the same target part of the ice maker, more heat is generated in the same duration by adopting the first heating strategy corresponding to the ice maker being in an ice-making operation state, compared to the second heating strategy corresponding to the ice maker being in a non-ice-making operation state, when the ambient parameter information is the same. Hereinafter, the relationship between the first heating strategy and the second heating strategy will be described by taking heating the target part of the ice maker based on different time on-off ratios by the first and second heating strategies as examples. For the same ice maker, in the ice-making operation state, the ambient temperature of the ambient in which the ice outlet of the ice maker located is 23 degrees, and the humidity thereof is 70%. The first heating strategy acquired according to the first heating strategy acquisition rule is heating the ice outlet of the ice maker based on the time on-off ratio of 1:1, that is, heating for 1 unit time, stopping heating for 1 unit time; in the non-ice-making operation state, the ambient temperature of the ambient in which the ice outlet of the ice maker located is the same 23 degrees, and the humidity thereof is 70%. The second heating strategy acquired according to the second heating strategy acquisition rule is heating the ice outlet of the ice maker based on the time on-off ratio of 1:1.3, that is, heating for 1 unit time, stopping heating for 1.3 unit time; therefore, with respect to the same target part of the same ice maker, more heat is generated in the same duration by adopting the second heating strategy compared to the first heating strategy when the ambient parameter information is the same. On one hand, it guarantees timely deicing or preventing being frozen, and on the other hand, it saves power consumption compared to the prior art.

In an embodiment of the present disclosure, similarly to the first heating strategy acquisition rule, the second heating strategy acquisition rule is any one of: acquiring a deicing heating control strategy having the time on-off ratio of the corresponding heaters, corresponding to the ambient parameter information of different numerical intervals; or acquiring a deicing heating control strategy having the corresponding heating power, corresponding to the ambient parameter information of different numerical intervals; or acquiring a deicing heating control strategy having the corresponding heating duration, corresponding to the ambient parameter information of different numerical intervals. It is determined that whether the ice maker is in a non-ice-making operation state, the ambient temperature and the humidity are distinguished when the ice maker is in the non-ice-making operation state, and the heater at the target part is controlled to be operated according to different on-off ratios or heating powers or heating durations. When the ambient temperature is >T1 and the ambient humidity is >H1, the heater at the target part is controlled to de-ice and heat the target part with an on-off ratio or a heating power or a heating duration A1; when T1≥the ambient temperature >T2, and H1≥the ambient humidity >H2, the heater at the target part is controlled to de-ice and heat the target part with an on-off ratio or a heating power or a heating duration A2; when T2≥the ambient temperature>T3, and H2 the ambient humidity>H3, the heater at the target part is controlled to de-ice and heat the target part with an on-off ratio or a heating power or a heating duration A3. Based on the second heating strategy, the heaters are controlled to heat the target part of the ice maker. In an embodiment of the present disclosure, which second heating strategy corresponding to the different ambient parameter information among the second heating policy acquisition rules is preset, and pre-calculated or pre-measured according to the structure and size of the target part of the ice maker and the heating power of the heaters; the second heating strategy is needed to ensure that after the target part of the ice maker is heated, no ice is present in the target part of the ice maker or even if ice is present, the ice maker can normally operate.

In the embodiments of the present disclosure, a heating control method is provided comprising: determining that the ice maker is in a non-ice-making operation state; acquiring a second heating strategy of a target part of the ice maker according to a preset second heating strategy acquisition rule, based on ambient parameter information of an ambient in which the target part of the ice maker is located; and heating the target part based on the second heating strategy. Therefore, the problem that the deicing heating control technology of the ice maker in the prior art has high energy consumption is solved, and the beneficial effect of precise and low-energy deicing heating control of the ice-prone parts of the ice maker is achieved.

Based on any one of the specific embodiments above of the present disclosure, a heating control method is provided. The target part of the ice maker is a water inlet pipe of the ice maker, an ice outlet of the ice maker, or a dispenser of the ice maker.

It should be noted that, during the ice making process of the ice maker, the parts that are easily exposed to the water flow may be affected by the residual cooling capacity or the low room temperature, causing icing, thereby affecting the normal ice-making operation of the ice maker. The target part of the ice making in this embodiment is not specifically limited.

Based on any one of the specific embodiments above of the present disclosure, a heating control method is provided, and the ambient parameter information includes one or more of temperature and humidity.

It should be noted that, in the specific embodiments above, detailed description has been made that the ambient of different temperatures or different humidity may affect the deicing heating speed of the ice-prone target part of the ice maker.

Based on any one of the specific embodiments above of the present disclosure, a heating control method is provided. The first heating strategy acquisition rule or the second heating strategy acquisition rule is: acquiring a deicing heating control strategy having the time on-off ratio for the corresponding heaters, corresponding to the ambient parameter information of different numerical intervals.

It should be noted that the time on-off ratio refers to the ratio of the actual operation time to the duration during which the heating function of the heaters is turned on. The smaller the time on-off ratio is, the more heat the heaters generate per unit time.

Further, since it is also taken into account that the ambient of different temperatures or different humidity will affect the deicing heating speed of the ice-prone target part of the ice maker. Therefore, according to the embodiment, a deicing heating control strategy having the time on-off ratio of the corresponding heaters is acquired corresponding to the ambient parameter information of different numerical intervals, and it is more reasonable and energy saving to control the heaters to heat the target part of the ice maker based on the first heating strategy or the second heating strategy.

Based on any one of the specific embodiments above of the present disclosure, a heating control method is provided. With respect to the same target part of the ice maker, the heating time on-off ratio among the first heating strategy corresponding to the ice maker being in an ice-making operation state is greater than that among the second heating strategy corresponding to the ice maker being in a non-ice-making operation state when the ambient parameter information is the same.

It is well understood that with respect to the same target part of the ice maker in the same ambient, the ice-prone parts of the ice maker is more prone to produce ice when the ice maker is in the ice-making operation state than when it is in the non-ice-making operation state, and thus in this embodiment, the heating time on-off ratio among the first heating strategy corresponding to the ice maker being in an ice-making operation state should be greater than that among the second heating strategy corresponding to the ice maker being in a non-ice-making operation state, and then it is more reasonable and energy saving to heat the target part of the ice maker.

Based on any one of the specific embodiments above of the present disclosure, a heating control method is provided. The first heating strategy acquisition rule or the second heating strategy acquisition rule is: acquiring a deicing heating control strategy having a corresponding heating power, corresponding to the ambient parameter information of different numerical intervals.

Further, since it is also taken into account that the ambient of different temperatures or different humidity will affect the deicing heating speed of the ice-prone target part of the ice maker. Therefore, according to the embodiment, a deicing heating control strategy having a heating power for the corresponding heaters is acquired corresponding to the ambient parameter information of different numerical intervals, and it is more reasonable and energy saving to control the heaters to heat the target part of the ice maker based on the first heating strategy or the second heating strategy.

Based on any one of the specific embodiments above of the present disclosure, a heating control method is provided. With respect to the same target part of the ice maker, the heating power among the first heating strategy corresponding to the ice maker being in an ice-making operation state is greater than that among the second heating strategy corresponding to the ice maker being in a non-ice-making operation state when the ambient parameter information is the same.

It is well understood that with respect to the same target part of the ice maker in the same ambient, the ice-prone parts of the ice maker is more prone to produce ice when the ice maker is in the ice-making operation state than when it is in the non-ice-making operation state, and thus in this embodiment, the heating power among the first heating strategy corresponding to the ice maker being in an ice-making operation state should be greater than that among the second heating strategy corresponding to the ice maker being in a non-ice-making operation state, and then it is more reasonable and energy saving to heat the target part of the ice maker.

Based on any one of the specific embodiments above of the present disclosure, a heating control method is provided. The first heating strategy acquisition rule or the second heating strategy acquisition rule is: acquiring a deicing heating control strategy having the heating duration of the corresponding heaters, corresponding to the ambient parameter information of different numerical intervals.

Further, since it is also taken into account that the ambient of different temperatures or different humidity will affect the deicing heating speed of the ice-prone target part of the ice maker. Therefore, according to the embodiment, a deicing heating control strategy having a heating duration of the corresponding heaters is acquired corresponding to the ambient parameter information of different numerical intervals, and it is more reasonable and energy saving to control the heaters to heat the target part of the ice maker based on the first heating strategy or the second heating strategy.

Based on any one of the specific embodiments above of the present disclosure, a heating control method is provided. With respect to the same target part of the ice maker, the heating duration among the first heating strategy corresponding to the ice maker being in an ice-making operation state is longer than that among the second heating strategy corresponding to the ice maker being in a non-ice-making operation state when the ambient parameter information is the same.

It is well understood that with respect to the same target part of the ice maker in the same ambient, the ice-prone parts of the ice maker is more prone to produce ice when the ice maker is in the ice-making operation state than when it is in the non-ice-making operation state, and thus in this embodiment, the heating duration among the first heating strategy corresponding to the ice maker being in an ice-making operation state should be longer than that among the second heating strategy corresponding to the ice maker being in a non-ice-making operation state, and then it is more reasonable and energy saving to heat the target part of the ice maker.

Figure 2:
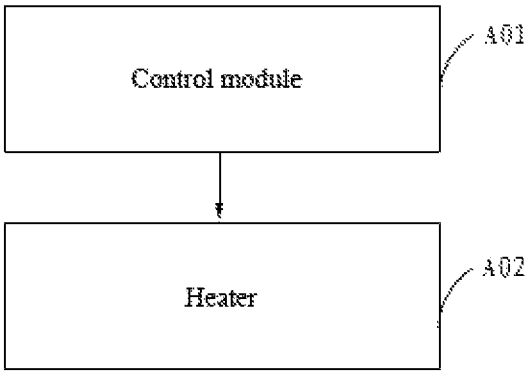
FIG. 2 is a schematic overall structural view of a heating control device according to an embodiment of the present disclosure.

As shown in FIG. 2, based on any one of the specific embodiments above of the present disclosure, a heating control device is provided, comprising a control module A01 and heaters A02, and the heaters A02 are arranged corresponding to the target part of the ice maker:

the control module A01 is configured to determine that the ice maker is in an ice-making operation state; acquire a first heating strategy of a target part of the ice maker according to a preset first heating strategy acquisition rule, based on ambient parameter information of an ambient in which the target part of the ice maker is located; and control the heaters A02 to heat the target part based on the first heating strategy. It should be noted that the control module can adopt a processing device such as an existing controller, a processor, and the like. The control module is connected to a heater line, sends a control command to the heater according to the heating strategy to control the heater to perform heating operation on the target part. The control module determines that the ice maker is in the ice-making operation state by confirming that the compressor of the ice maker is operating, or confirming that the ice maker is performing the ice-making process through a control chip of the ice maker, receives the information on the temperature or humidity collected by the sensor and acquires the heating strategy according to the temperature or humidity value based on the heating strategy acquisition rules.

It should be noted that, in order to save energy consumption, unlike the deicing heating control technology of the ice maker in the prior art, in the embodiments of the present disclosure, when the ice maker is in an power-on state, the control module A01 does not control the heaters at the ice-prone parts of the ice maker to be always in the heating state, and the heating operation is not performed according to the on-off-ratio at fixed time. Generally speaking, the ice maker will cause the ice-prone target part to become clogged in the following two cases, and the water cannot enter the ice maker, which affects the ice maker for normal ice making. One case is that water in the ice-prone target part of the ice maker is frozen due to the influence of the cold temperature after the end of the last or last few ice-making operation states; and the other case is that water in the ice-prone target part of the ice maker is frozen due to too low external room temperature. Usually, the ice maker does not enter the ice-making operation state at the first time after being turned on and it will cause the loss of electric energy if the control module A01 immediately controls the heaters A02 to heat the ice-prone target part of the ice maker for deicing after the ice maker is turned on. At the same time, water in the ice-prone target part of the ice maker is possible to be frozen again before the ice maker becomes the ice-making operation state next time, which further aggravates the loss of electric energy. In an embodiment of the present disclosure, the ice-prone target part of the ice maker is a water inlet pipe of the ice maker, an ice outlet of the ice maker or a dispenser of the ice maker.

Therefore, further, according to the embodiment of the present disclosure, the control module A01 does not control the heaters A02 to heat the ice-prone parts of the ice maker at the first time after the ice maker is turned on, but it firstly determines the ice maker is in the ice-making operation state and acquires ambient parameter information of an ambient in which the target part of the ice maker is located at the same time. Since it is taken into account that the ambient of different temperatures or different humidity will affect the deicing heating speed of the ice-prone target part of the ice maker, for example, the deicing heating speed of the ice-prone target part of the ice maker by the heaters A02 in a low ambient temperature is slower than that in a high ambient temperature; and the deicing heating speed of the ice-prone target part of the ice maker by the heaters A02 in a high ambient humidity is slower than that in a high ambient humidity. The control module A01 acquires the first heating strategy of a target part of the ice maker according to a preset first heating strategy acquisition rule based on acquired ambient parameter information of the ice maker. In an embodiment of the present disclosure, the first heating strategy acquisition rule is any one of: acquiring a deicing heating control strategy having the time on-off ratio of the corresponding heaters A02, corresponding to the ambient parameter information of different numerical intervals; or acquiring a deicing heating control strategy having the corresponding heating power, corresponding to the ambient parameter information of different numerical intervals; or acquiring a deicing heating control strategy having the corresponding heating duration, corresponding to the ambient parameter information of different numerical intervals. Based on the first heating strategy, the heaters A02 are controlled to heat the target part of the ice maker. In an embodiment of the present disclosure, the heaters A02 are any kind of device of the prior art that heats the target part of the ice maker, and the heaters A02 for heating the target part of the ice maker in the prior art are usually heating resistor wires or infrared heaters A02, etc. In an embodiment of the present disclosure, which first heating strategy corresponding to the different ambient parameter information among the first heating policy acquisition rules is preset, and pre-calculated or pre-measured according to the structure and size of the target part of the ice maker and the heating power of the heaters A02; the first heating strategy is needed to ensure that after the target part of the ice maker is heated, no ice is present in the target part of the ice maker or even if ice is present, the ice maker can normally operate. In an embodiment of the present disclosure, the ambient parameter information includes one or more of the temperature and humidity. This embodiment is not specifically limited.

According to the specific embodiments above of the present disclosure, a heating control device is provided, comprising a control module A01 and heaters A02, and the heaters A02 are arranged corresponding to the target part of the ice maker. The control module A01 is configured to: determine that the ice maker is in an ice-making operation state; acquire a first heating strategy of a target part of the ice maker according to a preset first heating strategy acquisition rule, based on ambient parameter information of an ambient in which the target part of the ice maker is located; and control the heaters A02 to heat the target part based on the first heating strategy. Therefore, the problem that the deicing heating control technology of the ice maker in the prior art has high energy consumption is solved, and the beneficial effect of precise and low-energy deicing heating control of the ice-prone parts of the ice maker is achieved.

Based on the specific embodiments above of the present disclosure, a heating control device is provided comprising: a control module A01 configured to determine that the ice maker is in a non-ice-making operation state; acquire a second heating strategy of a target part of the ice maker according to a preset second heating strategy acquisition rule, based on ambient parameter information of an ambient in which the target part of the ice maker is located; and control heaters A02 to heat the target part based on the second heating strategy.

It should be noted that, similar to the previous embodiment, in the embodiments of the present disclosure, the target part of the ice maker is not heated at the first time after the ice maker is turned on, but the ice maker is firstly determined to be in the non-ice-making operation state while ambient parameter information of an ambient in which the target part of the ice maker is located is acquired. The ice maker can be determined to be in the ice-making operation state through at least the following two ways: the compressor of the ice maker is determined to be operating or the ice maker is determined to be performing the ice-making process through the control chip of the ice maker. It is also taken into account that the ambient of different temperatures or different humidity will affect the deicing heating speed of the ice-prone target part of the ice maker. Therefore, according to an embodiment of the present disclosure, the second heating strategy of a target part of the ice maker is acquired according to a preset second heating strategy acquisition rule based on acquired ambient parameter information of the ice maker. With respect to the same target part of the ice maker, more heat is generated in the same duration by adopting the first heating strategy corresponding to the ice maker being in an ice-making operation state, compared to the second heating strategy corresponding to the ice maker being in a non-ice-making operation state, when the ambient parameter information is the same. Hereinafter, the relationship between the first heating strategy and the second heating strategy will be described by taking heating the target part of the ice maker based on different time on-off ratios by the first and second heating strategies as examples. For the same ice maker, in the ice-making operation state, the ambient temperature of the ambient in which the ice outlet of the ice maker located is 23 degrees, and the humidity thereof is 70%. The first heating strategy acquired according to the first heating strategy acquisition rule is heating the ice outlet of the ice maker based on the time on-off ratio of 1:1, that is, heating for 1 unit time, stopping heating for 1 unit time; in the non-ice-making operation state, the ambient temperature of the ambient in which the ice outlet of the ice maker located is the same 23 degrees, and the humidity thereof is 70%. The second heating strategy acquired according to the second heating strategy acquisition rule is heating the ice outlet of the ice maker based on the time on-off ratio of 1:1.3, that is, heating for 1 unit time, stopping heating for 1.3 unit time; therefore, with respect to the same target part of the same ice maker, more heat is generated in the same duration by adopting the second heating strategy compared to the first heating strategy when the ambient parameter information is the same. On one hand, it guarantees timely deicing or preventing being frozen, and on the other hand, it saves power consumption compared to the prior art.

In an embodiment of the present disclosure, similarly to the first heating strategy acquisition rule, the second heating strategy acquisition rule is any one of: acquiring a deicing heating control strategy having the time on-off ratio of the corresponding heaters A02, corresponding to the ambient parameter information of different numerical intervals; or acquiring a deicing heating control strategy having the corresponding heating power, corresponding to the ambient parameter information of different numerical intervals; or acquiring a deicing heating control strategy having the corresponding heating duration, corresponding to the ambient parameter information of different numerical intervals. Based on the second heating strategy, the heaters A02 are controlled to heat the target part of the ice maker. In an embodiment of the present disclosure, which second heating strategy corresponding to the different ambient parameter information among the second heating policy acquisition rules is preset, and pre-calculated or pre-measured according to the structure and size of the target part of the ice maker and the heating power of the heaters A02; the second heating strategy is needed to ensure that after the target part of the ice maker is heated, no ice is present in the target part of the ice maker or even if ice is present, the ice maker can normally operate.

Specific embodiments of the present disclosure provides a heating control device, comprising a control module A01 configured to determine that the ice maker is in a non-ice-making operation state; acquire a second heating strategy of a target part of the ice maker according to a preset second heating strategy acquisition rule, based on ambient parameter information of an ambient in which the target part of the ice maker is located; and control heaters A02 to heat the target part based on the second heating strategy. Therefore, the problem that the deicing heating control technology of the ice maker in the prior art has high energy consumption is solved, and the beneficial effect of precise and low-energy deicing heating control of the ice-prone parts of the ice maker is achieved.

Based on any one of the specific embodiments above of the present disclosure, a heating control device is provided. The target part of the ice maker is a water inlet pipe of the ice maker, an ice outlet of the ice maker, or a dispenser of the ice maker.

In an embodiment of the present disclosure, during the ice making process of the ice maker, the parts that are easily exposed to the water flow may be affected by the residual cooling capacity or the low room temperature, causing icing, thereby affecting the normal ice-making operation of the ice maker. The target part of the ice making in this embodiment is not specifically limited.

Based on any one of the specific embodiments above of the present disclosure, a heating control device is provided, and the ambient parameter information includes one or more of temperature and humidity.

It should be noted that, in the specific embodiments above, detailed description has been made that the ambient of different temperatures or different humidity may affect the deicing heating speed of the ice-prone target part of the ice maker.

Based on any one of the specific embodiments above of the present disclosure, a heating control device is provided. The first heating strategy acquisition rule or the second heating strategy acquisition rule is: acquiring a deicing heating control strategy having the time on-off ratio for the corresponding heaters A02, corresponding to the ambient parameter information of different numerical intervals.

It should be noted that the time on-off ratio refers to the ratio of the actual operation time to the duration during which the heating function of the heaters A02 is turned on. The smaller the time on-off ratio is, the more heat the heaters A02 generate per unit time.

Further, since it is taken into account that the ambient of different temperatures or different humidity will affect the deicing heating speed of the ice-prone target part of the ice maker. Therefore, according to the embodiment, a deicing heating control strategy having the time on-off ratio of the corresponding heaters A02 is acquired corresponding to the ambient parameter information of different numerical intervals, and it is more reasonable and energy saving to control the heaters A02 to heat the target part of the ice maker based on the first heating strategy or the second heating strategy.

Based on any one of the specific embodiments above of the present disclosure, a heating control device is provided. With respect to the same target part of the ice maker, the heating time on-off ratio among the first heating strategy corresponding to the ice maker being in an ice-making operation state is greater than that among the second heating strategy corresponding to the ice maker being in a non-ice-making operation state when the ambient parameter information is the same.

It is well understood that with respect to the same ice-prone target part of the ice maker in the same ambient, the ice-prone parts of the ice maker is more prone to produce ice when the ice maker is in the ice-making operation state than when it is in the non-ice-making operation state, and thus in this embodiment, the heating time on-off ratio among the first heating strategy corresponding to the ice maker being in an ice-making operation state should be greater than that among the second heating strategy corresponding to the ice maker being in a non-ice-making operation state, and then it is more reasonable and energy saving to heat the target part of the ice maker.

Based on any one of the specific embodiments above of the present disclosure, a heating control device is provided. The first heating strategy acquisition rule or the second heating strategy acquisition rule is: acquiring a deicing heating control strategy having the heating power of the corresponding heaters A02, corresponding to the ambient parameter information of different numerical intervals.

Further, since it is taken into account that the ambient of different temperatures or different humidity will affect the deicing heating speed of the ice-prone target part of the ice maker. Therefore, according to the embodiment, a deicing heating control strategy having a heating power for the corresponding heaters A02 is acquired corresponding to the ambient parameter information of different numerical intervals, and it is more reasonable and energy saving to control the heaters A02 to heat the target part of the ice maker based on the first heating strategy or the second heating strategy.

Based on any one of the specific embodiments above of the present disclosure, a heating control device is provided. With respect to the same target part of the ice maker, heating power among the first heating strategy corresponding to the ice maker being in an ice-making operation state is greater than that among the second heating strategy corresponding to the ice maker being in a non-ice-making operation state when the ambient parameter information is the same.

It is well understood that with respect to the same ice-prone target part of the ice maker in the same ambient, the ice-prone parts of the ice maker is more prone to produce ice when the ice maker is in the ice-making operation state than when it is in the non-ice-making operation state, and thus in this embodiment, the heating power among the first heating strategy corresponding to the ice maker being in an ice-making operation state is greater than that among the second heating strategy corresponding to the ice maker being in a non-ice-making operation state, and then it is more reasonable and energy saving to heat the target part of the ice maker.

Based on any one of the specific embodiments above of the present disclosure, a heating control device is provided. The first heating strategy acquisition rule or the second heating strategy acquisition rule is: acquiring a deicing heating control strategy having the heating duration of the corresponding heaters A02, corresponding to the ambient parameter information of different numerical intervals.

Further, since it is taken into account that the ambient of different temperatures or different humidity will affect the deicing heating speed of the ice-prone target part of the ice maker. Therefore, according to the embodiment, a deicing heating control strategy having a heating duration of the corresponding heaters A02 is acquired corresponding to the ambient parameter information of different numerical intervals, and it is more reasonable and energy saving to control the heaters A02 to heat the target part of the ice maker based on the first heating strategy or the second heating strategy.

Based on one of the specific embodiments above of the present disclosure, a heating control device is provided. With respect to the same target part of the ice maker, the heating duration among the first heating strategy corresponding to the ice maker being in an ice-making operation state is longer than that among the second heating strategy corresponding to the ice maker being in a non-ice-making operation state when the ambient parameter information is the same.

It is well understood that with respect to the same ice-prone target part of the ice maker in the same ambient, the ice-prone parts of the ice maker is more prone to produce ice when the ice maker is in the ice-making operation state than when it is in the non-ice-making operation state, and thus in this embodiment, the heating duration among the first heating strategy corresponding to the ice maker being in an ice-making operation state is longer than that among the second heating strategy corresponding to the ice maker being in a non-ice-making operation state, and then it is more reasonable and energy saving to heat the target part of the ice maker.

Figure 3:
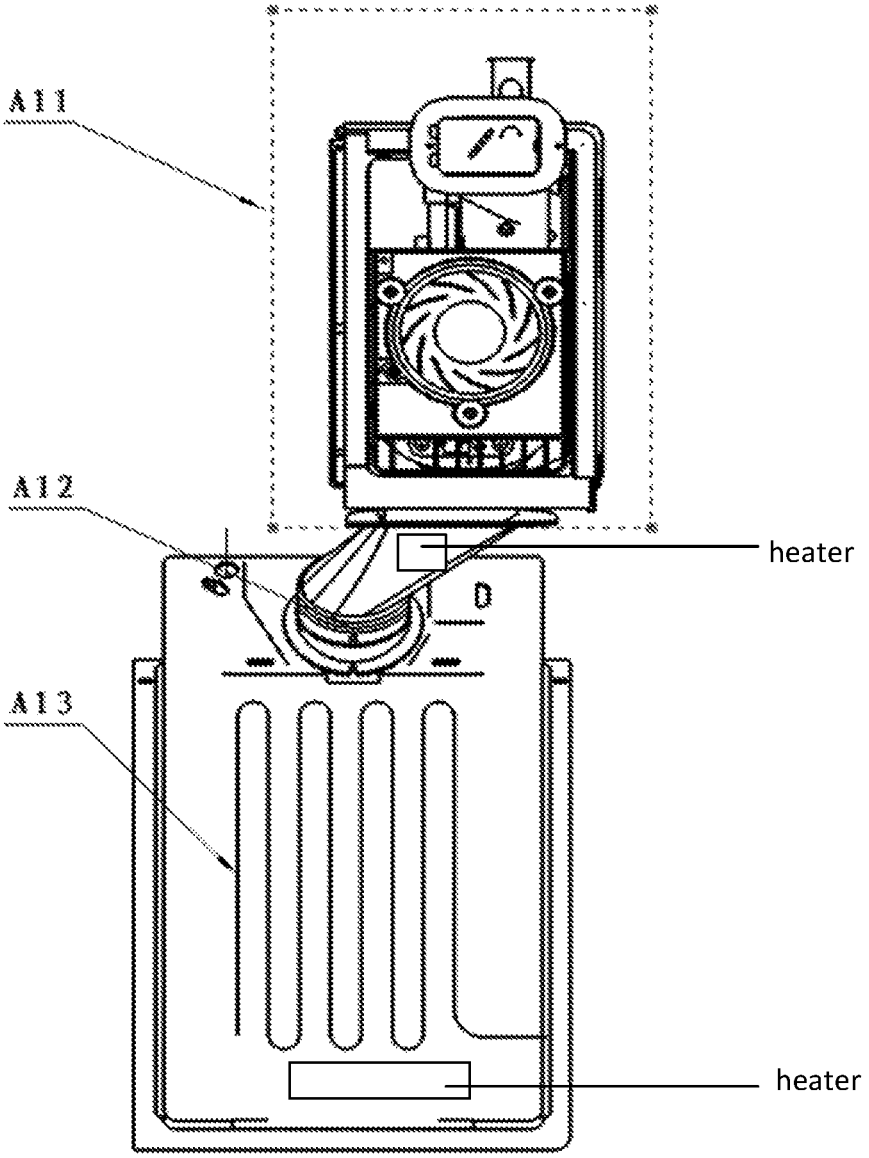
FIG. 3 is a schematic overall structural view of an ice maker in another heating control method according to an embodiment of the present disclosure.

Based on any one of the specific embodiments above of the present disclosure, a heating control method is provided. As shown in FIG. 3, the ice-prone target part of the ice maker A11 in this embodiment is the ice outlet A12 of the ice maker A11 or the dispenser A13 of the ice maker A11. Correspondingly, according to an embodiment of the present disclosure, the ice outlet A12 of the ice maker A11 or the dispenser A13 of the ice maker is heated by correspondingly arranging an ice outlet heater and a dispenser heater at the ice outlet A12 of the ice maker or the dispenser A13 of the ice maker A11.

Figure 4:
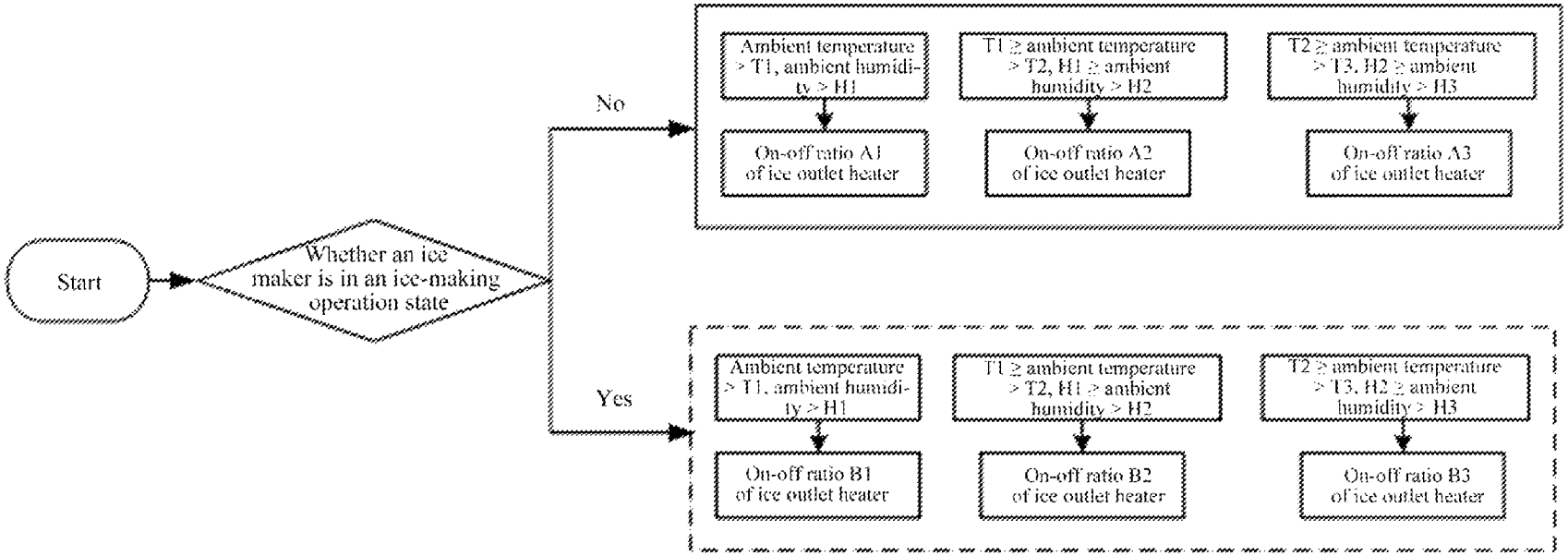
FIG. 4 is a schematic flow chart of another heating control method according to an embodiment of the present disclosure.

Based on any one of the specific embodiments above of the present disclosure, a heating control method is provided. As shown in FIG. 4, in this embodiment, the illustrative description is made by taking the ice-prone target part of the ice maker being the ice outlet of the ice maker as an example. Correspondingly, the ice outlet of the ice maker is heated by arranging the ice outlet heater at the ice outlet of the ice maker. The method specifically includes the following steps.

firstly, whether the ice maker is in the ice-making operation state is judged; when the ice maker is in the non-ice-making operation state, the ambient temperature and humidity are distinguished, the ice outlet heater is controlled to turn on and turn off according to different on-off ratios; when the ambient temperature is greater than T1 and when the ambient humidity is greater than H1, the ice outlet heater is controlled to heat the ice outlet part at an on-off ratio A1 for deicing; when the ambient temperature is greater than T2 and less than or equal to T1 and when the ambient humidity is greater than H2 and less than or equal to H1, the ice outlet heater is controlled to heat the ice outlet at an on-off ratio A2 for deicing; and when the ambient temperature is greater than T3 and less than or equal to T2 and when the ambient humidity is greater than H3 and is less than or equal to H2, the ice outlet heater is controlled to heat the ice outlet at an on-off ratio A3 for deicing.

When the ice maker is in the ice-making operation state, the ambient temperature and humidity are distinguished, and the ice outlet heater is controlled to turn on and turn off according to different on-off ratios; when the ambient temperature is greater than T1 and when the ambient humidity is greater than H1, the ice outlet heater is controlled to heat the ice outlet part at an on-off ratio B1 for deicing; when the ambient temperature is greater than T2 and less than or equal to T1 and when the ambient humidity is greater than H2 and less than or equal to H1, the ice outlet heater is controlled to heat the ice outlet at an on-off ratio B2 for deicing; and when the ambient temperature is greater than T3 and less than or equal to T2 and when the ambient humidity is greater than H3 and less than or equal to H2, the ice outlet heater is controlled to heat the ice outlet at an on-off ratio B3 for deicing.

Through the embodiment of the present disclosure, the energy consumption loss of the ice maker when performing deicing heating control can be reduced while ensuring that the ice outlet does not condense and ice.

Figure 5:
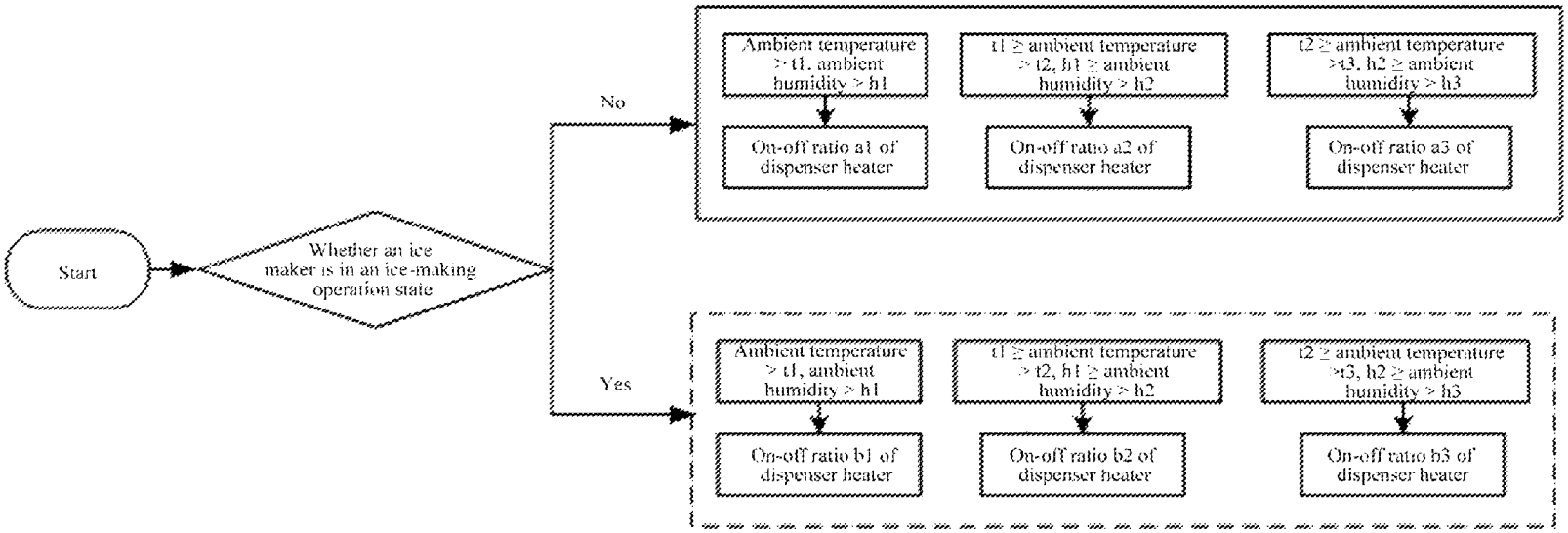
FIG. 5 is a schematic flow chart of still another heating control method according to an embodiment of the present disclosure.

Based on any one of the specific embodiments above of the present disclosure, a heating control method is provided. As shown in FIG. 5, in this embodiment, the illustrative description is made by taking the ice-prone target part of the ice maker being the dispenser of the ice maker as an example. Correspondingly, the dispenser of the ice maker is heated by arranging the dispenser heater at the dispenser of the ice maker. The method specifically includes the following steps.

firstly, whether the ice maker is in the ice-making operation state is judged; when the ice maker is in the non-ice-making operation state, the ambient temperature and humidity are distinguished, the dispenser heater is controlled to turn on and turn off according to different on-off ratios; when the ambient temperature is greater than t1 and when the ambient humidity is greater than h1, the dispenser heater is controlled to heat the dispenser part at an on-off ratio a1 for deicing; when the ambient temperature is greater than t2 and less than or equal to t1 and when the ambient humidity is greater than h2 and less than or equal to h1, the dispenser heater is controlled to heat the dispenser at an on-off ratio a2 for deicing; and when the ambient temperature is greater than t3 and less than or equal to t2 and when the ambient humidity is greater than h3 and less than or equal to h2, the dispenser heater is controlled to heat the dispenser at an on-off ratio a3 for deicing.

When the ice maker is in the ice-making operation state, the ambient temperature and humidity are distinguished, and the dispenser heater is controlled to turn on and turn off according to different on-off ratios; when the ambient temperature is greater than t1 and when the ambient humidity is greater than h1, the dispenser heater is controlled to heat the dispenser part at an on-off ratio b1 for deicing; when the ambient temperature is greater than t2 and less than or equal to t1 and when the ambient humidity is greater than h2 and less than or equal to h1, the dispenser heater is controlled to heat the dispenser at an on-off ratio b2 for deicing; and when the ambient temperature is greater than t3 and less than or equal to t2 and when the ambient humidity is greater than h3 and less than or equal to h2, the dispenser heater is controlled to heat the dispenser at an on-off ratio b3 for deicing.

Through the embodiment of the present disclosure, the energy consumption loss of the ice maker when performing deicing heating control can be reduced while ensuring that the dispenser does not condense and ice.

An example is taken as follows.

Figure 6:
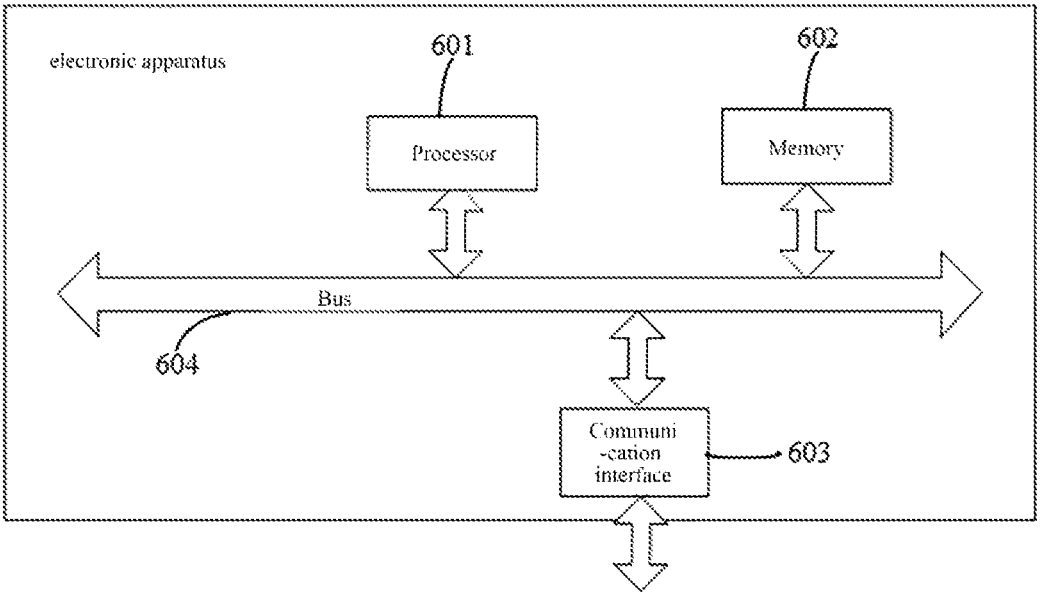
FIG. 6 is a schematic diagram of the physical structure of an electronic apparatus according to an embodiment of the present disclosure.

FIG. 6 is a schematic diagram of the physical structure of an electronic apparatus. As shown in FIG. 6, the electronic apparatus may include a processor 601, a communication interface 602, a memory 603, and a communication bus 604. The processor 601, the communication interface 602, and the memory 603 communicate with each other through the communication bus 604. The processor 601 can call the logic instruction in the memory 603 to perform the following method: determining that the ice maker is in an ice-making operation state; acquiring a first heating strategy of a target part of the ice maker according to a preset first heating strategy acquisition rule, based on ambient parameter information of an ambient in which the target part of the ice maker is located; and heating the target part based on the first heating strategy.

In addition, the logic instructions in the memory 603 described above may be implemented in the form of a software functional unit and may be stored in a computer readable storage medium while being sold or used as a separate product. Based on such understanding, the technical solution of the present disclosure in substance or a part of the technical solution which contributes to the prior art, may be embodied in the form of a software product, which is stored in a storage medium and includes several instructions to cause a computer device (which may be a personal computer, server, or network device, etc.) to perform all or part of the steps of the methods described in various embodiments of the present disclosure. The storage medium described above includes various medium capable of storing program codes, such as U disk, mobile hard disk, read-only memory (ROM), random access memory (RAM), magnetic disk, or optical disk, and the like.

The embodiments of the present disclosure also provide a non-transitory computer readable storage medium in which computer programs are stored, the computer programs are executed by the processor to implement the method provided by the foregoing embodiments, for example, comprising: determining that the ice maker is in an ice-making operation state; acquiring a first heating strategy of a target part of the ice maker according to a preset first heating strategy acquisition rule, based on ambient parameter information of an ambient in which the target part of the ice maker is located; and heating the target part based on the first heating strategy.

The device embodiments described above are merely illustrative, wherein the units described as separate components may or may not be physically separate, and the components displayed as units may or may not be physical units, that is, may be located at the same place, or it can be distributed to multiple network units. Some or all of the modules may be selected according to actual needs to achieve the purpose of the solution of the embodiment. Those of ordinary skill in the art can understand and implement the embodiments described above without paying creative labors.

Through the description of the embodiments above, those skilled in the art can clearly understand that the various embodiments can be implemented by means of software and a necessary general hardware platform, and of course, by hardware. Based on such understanding, the technical solution of the present disclosure in substance or a part of the technical solution which contributes to the prior art, may be embodied in the form of a software product, which is stored in a storage medium such as ROM/RAM, magnetic discs, optical discs, etc., and includes several instructions to cause a computer device (which may be a personal computer, server, or network device, etc.) to perform various embodiments or certain parts of the methods described in various embodiments.

Finally, it should be noted that the above embodiments are only used to explain the technical solutions of the present disclosure, and are not limited thereto; although the present disclosure is described in detail with reference to the foregoing embodiments, it should be understood by those skilled in the art that they can still modify the technical solutions described in the foregoing embodiments and make equivalent replacements to a part of the technical features; and these modifications and substitutions do not depart from the spirit and scope of the technical solutions of the embodiments of the present disclosure.

What is claimed is:

1. A heating control method, comprising:

determining that an ice maker is in an ice-making operation state;

acquiring ambient parameter information of an ambient in which a target part of the ice maker is located, wherein the ambient parameter information comprises at least humidity;

determining a first on-off time ratio of a heater for heating the target part based on the ambient parameter information; and heating the target part based on the first on-off time ratio;

the heating control method further comprising:

determining that the ice maker is in a non-ice-making operation state;

acquiring the ambient parameter information;

determining a second on-off time ratio of the heater for heating the target part based on the ambient parameter information, wherein the second on-off time ratio is less than the first on-off time ratio; and heating the target part based on the second on-off time ratio.

2. The heating control method of claim 1, wherein the target part of the ice maker is an ice outlet of the ice maker, or a dispenser of the ice maker.

3. The heating control method of claim 1, wherein determining that the ice maker is in the ice-making operation state is through at least one of following two ways: compressor of the ice maker is operating, or the ice maker is performing ice-making process through a control chip of the ice maker.

4. The heating control method of claim 1, wherein determining that the ice maker is in the non-ice-making operation state is through at least one of following two ways: the compressor of the ice maker is not operating, or the ice maker is not performing the ice-making process through a control chip of the ice maker.

5. The heating control method of claim 1, wherein the first on-off time ratio is 1:1, that is, heating for 1 unit time, stopping heating for 1 unit time.

6. The heating control method of claim 1, wherein the second on-off time ratio is 1:1.3, that is, heating for 1 unit time, stopping heating for 1.3 unit time.

7. An electronic apparatus, comprising a memory, a processor, and computer programs stored on the memory and executable on the processor, the processor is configured to implement steps of the heating control method according to claim 1 when executing the computer programs.

8. A non-transitory computer readable storage medium, storing computer instructions that cause the computer to perform the heating control method according to claim 1.

9. A heating control device, comprising: a processor and a heater, wherein the heater is located near a target part of an ice maker:

the processor is configured to:

determine that the ice maker is in an ice-making operation state;

acquire ambient parameter information of an ambient in which a target part of the ice maker is located, wherein the ambient parameter information comprises at least humidity;

determine a first on-off time ratio of a heater for heating the target part based on the ambient parameter information; and control the heater to heat the target part based on the first on-off time ratio;

wherein the processor is further configured to:

determine that the ice maker is in a non-ice-making operation state;

acquire the ambient parameter information;

determine a second on-off time ratio of the heater for heating the target part based on the ambient parameter information, wherein the second on-off time ratio is less than the first on-off time ratio; and control the heater to heat the target part based on the second on-off time ratio.

10. The heating control device of claim 9, wherein the target part of the ice maker is an ice outlet of the ice maker, or a dispenser of the ice maker.

11. The heating control device of claim 9, wherein determining that the ice maker is in the ice-making operation state is through at least one of following two ways: compressor of the ice maker is operating, or the ice maker is performing ice-making process through a control chip of the ice maker.

12. The heating control device of claim 9, wherein determining that the ice maker is in the non-ice-making operation state is through at least one of following two ways: the compressor of the ice maker is not operating, or the ice maker is not performing the ice-making process through a control chip of the ice maker.

13. The heating control device of claim 9, wherein the first on-off time ratio is 1:1, that is, heating for 1 unit time, stopping heating for 1 unit time.

14. The heating control device of claim 9, wherein the second on-off time ratio is 1:1.3, that is, heating for 1 unit time, stopping heating for 1.3 unit time.

15. An ice maker, comprising the heating control device according to claim 9.

* * * * *